US005700100A

United States Patent [19]

Ackermann

[11] Patent Number: 5,700,100

[45] Date of Patent: Dec. 23, 1997

[54] MASCARA CONTAINER HAVING A STIRRER AND A SEPARATE WIPER

[75] Inventor: Walter T. Ackermann, Watertown, Conn.

[73] Assignee: Risdon Corporation, Naugatuck, Conn.

[21] Appl. No.: 803,080

[22] Filed: Feb. 20, 1997

[51] Int. Cl.[6] ..... A45D 40/00

[52] U.S. Cl. ..... 401/4; 401/122

[58] Field of Search ..... 401/4, 122

[56] References Cited

U.S. PATENT DOCUMENTS 402,326 4/1889 Hoerle ..... 401/122

3,209,387 10/1965 Lukesch ..... 401/4

5,172,992 12/1992 Ackermann ..... 401/4

*Primary Examiner*—Steven A. Bratlie

*Attorney, Agent, or Firm*—Dallett Hoopes

[57] ABSTRACT

Mascara stirrer has a tubular hub rotatable in the container neck. The hub is formed with a lateral slot, and a generally annular wiper is adapted to slide into the slot and be generally centered in the opening of the tubular hub and trapped in place by the wall of the container neck.

6 Claims, 2 Drawing Sheets

MASCARA CONTAINER HAVING A STIRRER AND A SEPARATE WIPER

FIELD OF THE INVENTION

This invention relates to a mascara container which is provided with a stirrer. More specifically, for such a mascara container, the invention provides a separate wiper for the stirrer so that a wiper tailored to the applicator and mascara can be selected.

BACKGROUND OF THE INVENTION

In my U.S. Pat. No. 5,172,992 issued Dec. 22, 1992, assigned to my assignee, there is disclosed a mascara container having a stirrer with a tubular hub. When the stirrer is in place, the hub fits rotatably into the neck of the container, the hub receiving axially therethrough a conventional mascara applicator, part of the container screw cap. The upper end of the applicator is non-circular as is the opening in the tubular hub so that when the cap is screwed on or off, there is an automatic rotation of the stirrer.

The embodiment disclosed in the patent featured a unitary wiper, part of the tubular hub, which, as the applicator is withdrawn out through the hub, squeegees off the brush, permitting excess mascara to fall to the bottom of the container.

It has been recognized in the cosmetic industry that there is a need for applicators of various character and configuration. The reason is that certain mascara liquids are thinner than others. Also, there are customers' preference for brush-type applicators or ribbed solid applicator rods, etc. The variety of such applicators means that the wipers for each container must be of carefully selected internal configurations.

There has been no means for providing optimum wipers other than, of course, by molding of the hubs of stirrers with different internal wiping openings. A need has existed, therefore, for mascara containers with stirrers having a variety of possible wiper internal shapes so that the designer can select the one preferred with the applicator and mascara used. It is to this need that the present invention is directed.

SUMMARY OF THE INVENTION

The invention, therefore, is a mascara container having a reduced neck and a stirrer fitting inside the container having a tubular hub rotatable in the neck. The hub is formed with a lateral slot and, a generally annular wiper is adapted to slide into the slot and be generally centered in the opening of the tubular hub, trapped in place by the side wall of the container neck.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 4:
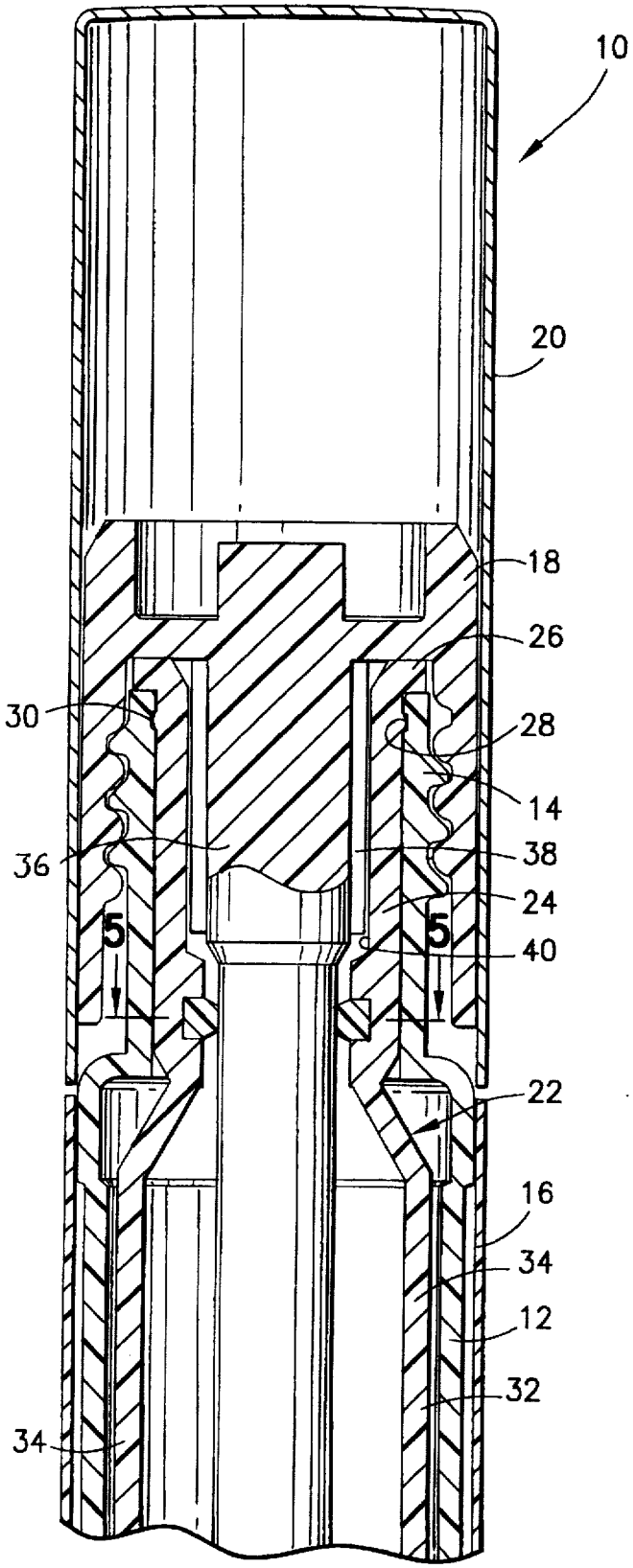
FIG. 4 is an enlarged fragmentary sectional view of a mascara container embodying the invention. The applicator is shown partly in profile.

A mascara container embodying the invention is generally designated 10 in FIG. 4. It comprises an elongated generally cylindrical hollow body 12 which may be of plastic or glass and is formed with a reduced threaded neck. It may be provided with a tight-fitting decorative sheath 16, of metal or plastic.

A plastic screw cap 18 which may also have a sheath 20 is provided for the hollow body 12. The plastic stirrer 22, as in my patent above, features a tubular hub 24 with an outward flange 26 at its upper end. The flange rests on the top of the neck 14. As shown in FIG. 4, the hub may be formed with a circumferential detent ridge 28 which snaps into a groove 30 about the inside of the mouth to hold the stirrer rotatably in position. Formed unitarily with the hub is the elongate open frame 32 which has parallel sides 34 spaced inward slightly from the side wall of the hollow body 12.

Formed integrally with the screw cap 18 is the applicator 36 which extends down centrally along the axis of the cap and is longitudinally ribbed at its upper end as at 38. The hub 24 is formed with an opening 40 therethrough (FIG. 4), the upper part of which is also longitudinally ribbed.

The frame 32 includes, aside from the parallel sides 34, a semi-circular lower end, not shown. Preferably, the sides 34 and the end are uniformly rectangular in cross-section.

The stirrer is molded with the screw cap of one piece of plastic which may be polypropylene, polyethylene, nylon or acetal resin, for instance, and the dimensions of the parts of the frame are such that the frame may flex; that is, the sides may be squeezed together or the frame may be axially twisted as described in my patent.

Thus, as described in the patent, in installation of the stirrer into the hollow body 12, the end of the frame and the sides may be squeezed together to enter the neck 14 of the container. When the stirrer is fully installed, the frame will return to its original molded shape. During the installation, the retaining ridge 28 will be compressed as the hub 22 slides into the neck 14. When it is fully installed, the ridge 28 will snap into the groove 30 to retain the stirrer in the container yet still be relatively rotatable.

When the applicator is being installed in the container, its brush (not shown) is inserted into the opening in hub 24. As the threads on the neck 14 begin to engage the threads on the inside of the cap 18, the non-circular upper end 38 of the applicator 36 keys into the non-circular opening 40 in the stirrer causing the stirrer 22 to rotate with the turning cap as it is screwed on. In this way the mascara is stirred.

Figure 1:
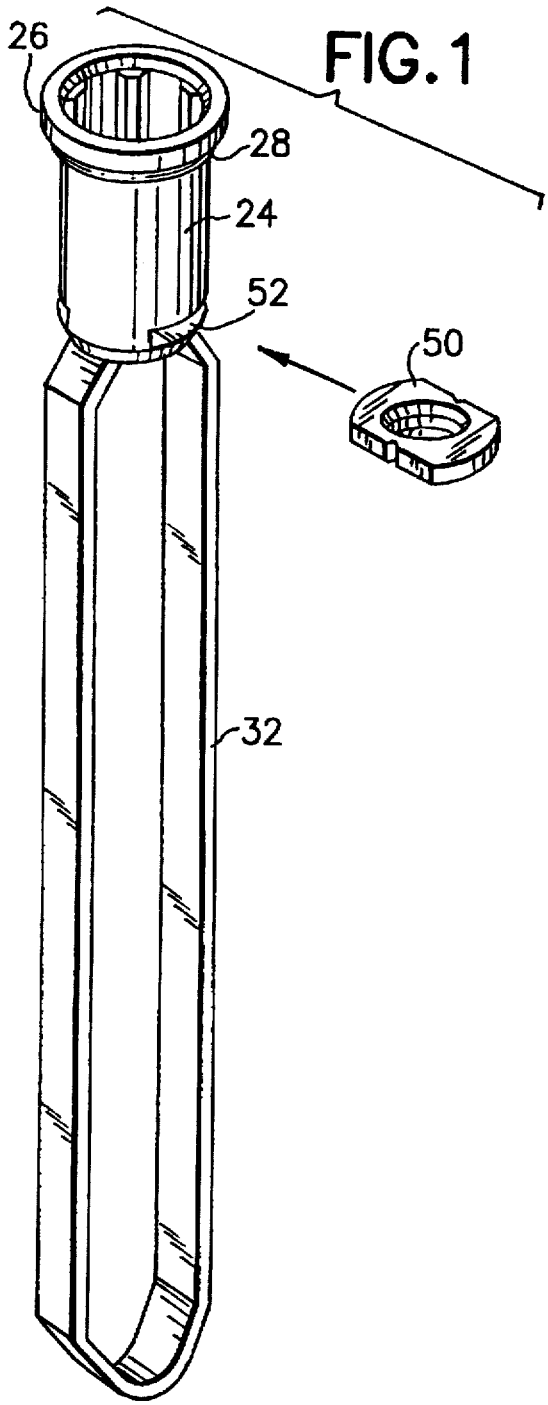
FIG. 1 is an exploded perspective view of a stirrer and wiper embodying the invention.
Figure 2:
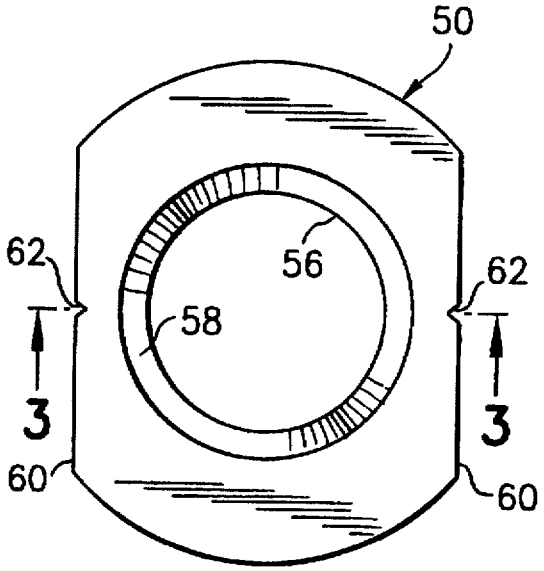
FIG. 2 is a greatly enlarged top plan view of the wiper.
Figure 3:
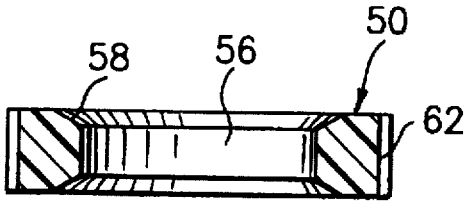
FIG. 3 is a sectional view taken on the line 3—3 of FIG. 2.
Figure 5:
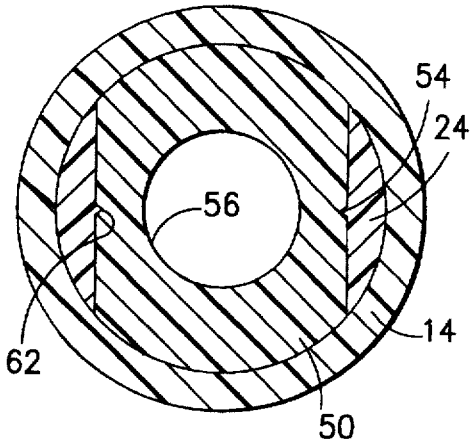
FIG. 5 is a sectional view taken on the line 5—5 of FIG. 4.

An essential feature of the present invention is the wiper 50 (FIG. 2). In further description of the stirrer, the lower end of the hub 24 is formed with a transverse slot 52 of width considerably less than the outer diameter of the hub but greater than the opening 40. At their midpoint, the sides of the slot may be formed with inward nibs 54 (FIG. 5). It is into this transverse slot 52 that the wiper 50 slides.

Referring more specifically to the nature of the wiper 50 in FIG. 2, it is shown to be generally annular having a circular opening 56 which may have lead-in chamfers 58 in both directions. As shown in FIG. 2, opposite sides of the wiper are truncated to provide flat parallel surfaces 60. Notches 62 are formed at the center of the flat sides to cooperate with the nibs 54—as a sort of "spring detent"—for the purpose of locating and temporarily retaining the wiper in the slot during installation.

The outer diameter of the wiper measured across its curved ends is slightly less than the inside diameter of the bottle neck 14 (FIG. 5) so that, as shown in FIG. 5, when the wiper is installed, it is held trapped within the side walls of the neck 14 yet not inhibit easy rotation of the stirrer by the cap.

By virtue of this construction, it is possible to select an appropriate wiper for a given applicator. When the selection is made, prior to assembly, the selected wiper is merely maneuvered into the slot with the flat sides 60 oriented with the direction of the slot. The notches 62 and nibs 54 cooperate to locate the correct placement of the wiper. With the wiper in place in the hub of the stirrer, the stirrer may be collapsed, as described already, and inserted into the neck, it reaches "home" position and the detent ridge 28 snaps into the groove 30. At this point, as shown in FIG. 5, the curved ends of the wiper are held in place by the curved wall of the container neck. It will be understood that for a given molded stirrer a number of wipers may be used selectively depending on the nature of the applicator and liquid.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. In a mascara container having a cylindrical body comprising a side wall and a circular bottom end wall and an externally threaded reduced neck at the upper end, a stirrer for said container comprising a molded plastic hub rotatably secured in the neck and a collapsible agitator within the container and secured to and integrally molded with the hub, the agitator being in the form of an oblong open frame of uniform cross-section and having straight parallel side elements and semicircular ends, the hub having an opening therethrough, an internally threaded cap for the container and an elongate mascara applier secured to and extending axially from the cap through the opening in the hub, the end of the applier proximate the cap being keyed for rotation with the hub; the improvement of the hub having a transverse slot with parallel edges extending therethrough and being wider than and intercepting the opening in the hub, and an annular wiper having outer portions of the same outside diameter as the outside of the hub, the wiper receiving the applier through its opening.

2. A container as claimed in claim 1 wherein other portions of the wiper intermediate the outer portions are bounded by parallel edges proximate the parallel edges of the slot in the hub.

3. A container as claimed in claim 1 wherein the sides and ends of the agitator are rectangular in cross-section and the ends of the frame are semi-circular.

4. A container as claimed in claim 1 wherein the hub and frame are a unitary molded structure.

5. A container as claimed in claim 1 wherein the hub has cylindrical outer surface with an outward retainer flange on the outer end thereof resting against the outer end of the neck and a rib on the hub spaced from the flange and engaging in an annular groove about the inside of the bottle neck.

6. A container as claimed in claim 1 wherein the sides of the slot and the sides of the wiper are formed with cooperative detents.

* * * * *